US011905772B2

(12) United States Patent
Saraya

(10) Patent No.: US 11,905,772 B2
(45) Date of Patent: Feb. 20, 2024

(54) METHODS AND SYSTEMS FOR DISCONNECTING AND RECONNECTING CASING

(71) Applicant: Vertice Oil tools Inc., Stafford, TX (US)

(72) Inventor: Mohamed Ibrahim Saraya, Sugarland, TX (US)

(73) Assignee: VERTICE OIL TOOLS INC., Stafford, TX (US)

( * ) Notice: Subject to any disclaimer, the term of this patent is extended or adjusted under 35 U.S.C. 154(b) by 165 days.

(21) Appl. No.: 17/526,114

(22) Filed: Nov. 15, 2021

(65) Prior Publication Data

US 2022/0074277 A1 Mar. 10, 2022

Related U.S. Application Data

(63) Continuation of application No. 16/552,722, filed on Aug. 27, 2019, now Pat. No. 11,203,907, which is a continuation-in-part of application No. 16/423,367, filed on May 28, 2019, now Pat. No. 10,435,958, and a continuation of application No. PCT/US2019/034127, filed on May 28, 2019, said application No. 16/423,367 is a continuation-in-part of application No. 16/275,993, filed on Feb. 14, 2019, now Pat. No. 10,400,521, which is a continuation of application No. 16/256,804, filed on Jan. 24, 2019, now Pat. No. 10,895,122.

(51) Int. Cl.

| | |
|---|---|
| ***E21B 23/00*** | (2006.01) |
| ***E21B 31/20*** | (2006.01) |
| ***E21B 33/13*** | (2006.01) |
| ***E21B 34/06*** | (2006.01) |
| ***E21B 17/04*** | (2006.01) |

(52) U.S. Cl.

CPC ..... *E21B 23/00* (2013.01); *E21B 17/04* (2013.01); *E21B 31/20* (2013.01); *E21B 33/13* (2013.01); *E21B 34/063* (2013.01)

(58) Field of Classification Search

CPC ..... E21B 17/04; E21B 17/043; E21B 17/046; E21B 17/06

See application file for complete search history.

(56) References Cited

U.S. PATENT DOCUMENTS 4,911,237 A * 3/1990 Melenyzer ..... E21B 23/042 166/212
5,743,335 A * 4/1998 Bussear ..... E21B 33/16 166/242.7
5,960,884 A * 10/1999 Echols ..... E21B 34/142 166/317

* cited by examiner

*Primary Examiner* — Cathleen R Hutchins
(74) *Attorney, Agent, or Firm* — Pierson IP, PLLC

(57) ABSTRACT

A tool to remove portions of casing from a wellbore. A tool may include a bottom sub-assembly and casing that selectively detach from a sub-assembly. This may allow for tools and casing within the wellbore to be efficiently and effectively removed from the wellbore without having to cut tools down well.

20 Claims, 10 Drawing Sheets

METHODS AND SYSTEMS FOR DISCONNECTING AND RECONNECTING CASING

CROSS-REFERENCE TO RELATED APPLICATIONS

This application is related to U.S. 16/256,804 filed on Jan. 24, 2019 and 16/275,993 filed on Feb. 14/2019, which are fully incorporated herein by reference in its entirety.

BACKGROUND INFORMATION

FIELD OF THE DISCLOSURE

Examples of the present disclosure relate to disconnecting and reconnecting portions of casing from a wellbore. More specifically, embodiments include a tool with an upper sub-assembly and lower sub-assembly that are configured to be detached from each other while inside the wellbore, and the lower sub-assembly is configured to receive a seal assembly that can seal the annulus from the tubing inner diameter

BACKGROUND

Directional drilling is the practice of drilling non-vertical wells. Horizontal wells tend to be more productive than vertical wells because they allow a single well to reach multiple points of the producing formation across a horizontal axis without the need for additional vertical wells. This makes each individual well more productive by being able to reach reservoirs across the horizontal axis. While horizontal wells are more productive than conventional wells, horizontal wells are costlier.

Conventionally, casings can be run all way to the surface which adds an extra cost of casing length. Other methods can include hanging the casing just above the horizontal or deviated section using a packer, a liner hanger, combination of both. Although this can be a cheaper method, it is still expensive and increases operational complexity. Alternative methods include running the casing all the way to the surface, then intervening with mechanical or chemical cuts to severe the casing at a point above the horizontal section. However, this provides uncertainty of a shape and condition of the severed portion for re-entry purposes.

Accordingly, needs exist for systems and methods to mechanically remove or disconnect portions of casing and assemblies from a wellbore, while the assemblies are within the wellbore.

Further, needs exist for a system and methods to allow for a secondary annular sealing between lower installed casing and a newly installed string above. This may be extremely important in embodiments wherein cementing remedial jobs are required in the annular volume of the lower installed casing, or to seal the annular volume above from tubing internal diameter during production.

SUMMARY

Embodiments disclosed herein describe systems and methods for a tool to remove and/or reconnect portions of casing and assemblies from a wellbore. In embodiments, a bottom sub-assembly and casing may be configured to be selectively detached from an upper sub-assembly. This may allow for tools and casing within the wellbore to be efficiently and effectively removed from the wellbore without having to cut tools downhole. Embodiments may include independent parts including, a bottom sub-assembly, housing, and upper sub-assembly. In other concepts, the embodiments disclosed herein may describe systems and methods for a tool to be used to severe, detach and/or reattach portions of the casing or assembly from the rest of the casing joints without removing the detached casing from the well bore The upper sub-assembly, housing, and the lower sub-assembly may be run in the wellbore as a single piece, wherein the housing and the upper sub-assembly may be coupled together with offset fingers that are configured to be an anti-rotational lock. The anti-rotational lock may be utilized before the upper sub-assembly is disconnected from the lower sub-assembly. The support sleeve may be configured to support a collet, dogs, dies, or any other device (hereinafter collectively and individually referred to as "collet") shouldered on a no-go, and prevent the collet from collapsing. The support sleeve may be connected to the upper sub-assembly via shear pins, dissolvable ring, or any other temporary coupling device.

The bottom sub-assembly may include a burst disc. In operation, the tool may be positioned within the wellbore. Pressure within the tool may be increased, and the burst disc may rupture. This may enable circulation at the top of the casing to circulate any excess cement that was bumped through the tool and through the casing shoe and back into the annulus side within the wellbore below the tool to return through the tool. The bottom sub-assembly may also include a cutout that allows for the linear movement of a support sleeve.

The housing may have a distal end coupled the bottom sub-assembly. A proximal end of the housing may be positioned adjacent to the top sub-assembly. The proximal end of the housing may include an anti-rotational lock that is configured to limit the rotation of the upper sub-assembly with respect to the housing. The anti-rotational lock may include a first set of fingers and a first set of grooves, which may be configured to be interfaced with a second set of fingers and a second set of grooves on the outer sidewall of the upper sub-assembly. In embodiments, the anti-rotational lock may also include beveled, sloped, tapered, etc. edges, which are configured to assist with re-entry of further tools. The housing may be positioned adjacent to a wellbore, or on an inner diameter of existing casing. This may enable the tool to be positioned within existing casing, or next to the geological formation. In embodiments, the housing may include a no-go that is configured to decrease the inner diameter from a first inner diameter to a second inner diameter. The no-go may be configured to limit the movement of the upper sub-assembly towards the distal end of the housing in a first mode of operation, while allowing the movement of the upper sub-assembly towards the distal end of the housing in a second mode of operation. In other concepts, the outer housing may be a part of the upper sub or the bottom sub. In embodiments, the bottom sub-assembly and housing may be configured to be a permanent part of the casing liner downhole within the wellbore, and be configured to be coupled with a seal bore extension. This may be configured to seal an annulus between production tubing and the casing from a producing zone.

The upper sub-assembly may include an outer sidewall, adjuster sleeve, and support sleeve. The outer sidewall may be configured to be positioned adjacent to and on the distal end of the housing in the first mode of operation, while be coupled to the adjuster sleeve in the first mode and the second mode. In other concepts, the support sleeve may be a part of the bottom sub-assembly.

The adjuster sleeve may include an upper portion, shaft, and lower portion. The upper portion may include a groove, positioned on an inner sidewall of the adjuster sleeve, which is configured to receive the support sleeve in the first mode of operation. An outer sidewall of the adjuster sleeve may be configured to be positioned adjacent to the housing. The shaft of the adjuster sleeve may be configured to increase an inner diameter across adjuster sleeve between the upper portion and lower portion of the adjuster sleeve. In embodiments, the shaft may include a series of ports. The series of ports may be positioned above a proximal end of the support sleeve when the support sleeve is decoupled from the adjuster sleeve. The ports may be configured to allow communication between an inner diameter of the adjuster sleeve and annulus outside of the outer diameter of the adjuster sleeve. This may allow for the drainage of fluid from the inner diameter of the adjuster sleeve while the upper sub-assembly is being removed from the wellbore. The lower portion of the adjuster sleeve may include an inner projection and an outer projection. The inner projection may be configured to decrease the inner diameter of the lower portion of the adjuster sleeve, and the outer projection may be configured to increase the outer diameter of the lower portion of the adjuster sleeve.

The support sleeve may include a seat, first outcrop, second outcrop, and ports. The seat may be configured to decrease the inner diameter across the support sleeve, and allow a ball to rest within the support sleeve. Responsive to the ball being positioned on the seat, pressure within the tool above the ball may increase, allowing the support sleeve to detach from the adjuster sleeve at a first location and move towards the distal end of the wellbore. This may allow the support sleeve to move towards a distal end of the wellbore. In response to the support sleeve moving towards the distal end of the wellbore, the ports extending through the support sleeve may be utilized to indicate a pressure drop within the tool. In other concepts, the support sleeve may be connected to the bottom sub-assembly.

In other embodiments, the support sleeve may include a recess, profile, or other indention on the inner diameter of the support sleeve that is configured to allow a running tool to engage the support sleeve. Responsive to the recess receiving force from the running tool, the support sleeve may detach from the adjuster sleeve at a first location and move towards a second location. This may allow the support sleeve to move towards a distal end or proximal end of the wellbore. In response to the support sleeve moving towards the second location, the ports extending through the support sleeve may be utilized to indicate a pressure drop within the tool. In other concepts, the support sleeve may be connected to the bottom sub-assembly.

The support sleeve may further include, a length extension, a weak point or a recess that allows receiving a mechanical or chemical cut to severe it. Hence provide a secondary mechanism to disconnect the housing if the ball drop mechanism fails or if the user opts not to use the ball.

The first outcrop and the second outcrop may be positioned on an outer sidewall of the support sleeve, and increase an outer diameter the support sleeve. A slot may be formed between the first outcrop and the second outcrop. Responsive to the support sleeve moving towards a distal end of the wellbore, the inner projection of the adjuster sleeve may be positioned within the slot, and against a lower surface of the second outcrop. When the adjuster sleeve applies forces towards a proximal end of the wellbore, the inner projection of the adjuster sleeve may apply forces against the second outcrop, coupling the support sleeve and adjuster sleeve at a second location, and pull the support sleeve towards the proximal end of the wellbore.

In embodiments, the bottom sub-assembly and the housing may include a seal bore. The seal bore may be configured to allow a seal assembly to sting in and provide a sealant between the annulus and the inside diameter of the casing. This may be needed to allow for cement job remediation to the casing below through preforming cement squeeze job. Additionally, the seal assembly may be beneficial to isolate the annulus above from the produced well fluid during production operations.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
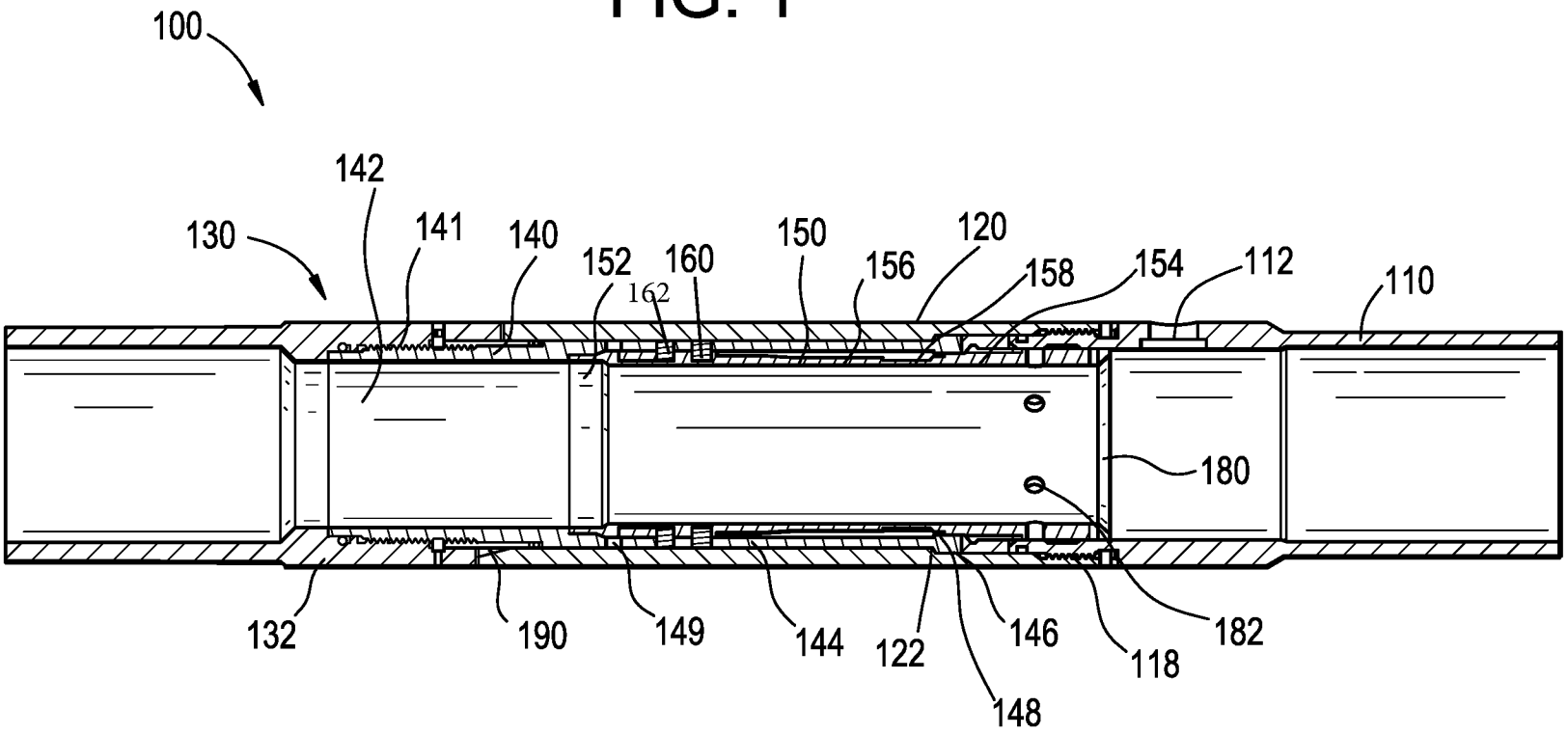
FIG. 1 depicts a tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a detachable tool 100 for use in a wellbore, according to an embodiment. In embodiments, the detachable tool 100 may be configured to be run in hole (RIH) with a balanced pressure where the connection is not shearable. In embodiments, a shearing element, such as a shear pin may be connected to a support sleeve, which supports the collet, and may be balanced as long as a ball is not seated on a ball seat. This may enable shearable, burstable, etc. elements of tool 100 to remain intact while being RIH. Tool 100 may include a bottom sub-assembly 110, housing 120, and top-sub assembly 130.

Bottom sub-assembly 110 may be configured to be positioned at a distal end of a wellbore. The bottom sub-assembly 110 may be configured to be a permanent part of casing, and remain within the wellbore after upper sub-assembly 130 is disconnected from housing 120. Bottom sub-assembly 110 may be configured to be positioned adjacent to casing liner downhole within the wellbore, and be configured to be coupled with a seal bore extension. This may be configured to seal an annulus between production tubing and the casing from a producing zone.

Bottom sub-assembly 110 may include a burst disc 112, and coupling mechanism 118.

Burst disc 112 may be configured to be positioned in a passageway that extends from an inner diameter of tool 100 to an annulus positioned between tool 100 and another structure, such as an outside casing or a geological formation. Burst disc 112 may be configured to rupture, break, fragment, dissolve, etc. by applying a predetermined pressure across the rupture disc or after a predetermined amount of time. In embodiments, before burst disc 112 is ruptured the annulus between an outer diameter of tool 100 and the inner diameter of tool 100 may be isolated from each other. Responsive to burst disc 112 being ruptured, there may be communication between the annulus and the inner diameter of tool 100 via the exposed passageway. This may enable excess cement and fluid to travel through the passageway and towards the surface. In other embodiments, the burst disc may be placed in the housing or the top sub-assembly or directly adjacent to the collet Coupling mechanisms 118 may be positioned on an outer diameter of the proximal end of bottom sub-assembly 110. The coupling mechanisms 118 may be configured to selectively couple bottom sub-assembly 110 and housing 120.

Housing 120 may be a sidewall with an outer diameter that is configured to be positioned adjacent to an outer casing, wall, cement, or geological formation. In embodiments, a distal end of housing 120 may be coupled to bottom sub-assembly 110, and a proximal end of housing 120 may be coupled to top sub-assembly 130. The proximal end of housing 120 may include a beveled anti-rotational lock 190. Anti-rotational lock 190 may be configured to limit the rotation of upper sub-assembly 130 with respect to the housing 120. The anti-rotational lock 190 may include a first set of fingers and a first set of grooves, which may be configured to be interfaced with a second set of fingers and a second set of grooves on the outer sidewall of the upper sub-assembly. In embodiments, the beveled, sloped, tapered, etc. edges, of anti-rotational lock 190 may be configured to assist with re-entry of further tools within an inner diameter housing 120.

An upper portion of housing 120 may have a first inner diameter, and a bottom portion of housing 120 may have a second inner diameter, wherein the second inner diameter is greater than the first inner diameter. A stop, no-go, outcrop, etc. 122 may be positioned between the upper and lower portions of housing 120, wherein no-go 122 may be configured to limit the movement of upper sub-assembly 130 when shear pin 160 is coupling adjuster sleeve 140 and support sleeve 150. As such, when adjuster sleeve 140 and support sleeve 150 are coupled together via shear pin 160, no-go 122 may form an overhang over portions of adjuster sleeve 140. This may limit the movement of upper sub-assembly towards the proximal end of tool 100 when portions of adjuster sleeve 140 are aligned with no-go 122. However, when portions of adjuster sleeve 140 are not aligned with no-go 122, upper sub-assembly 130 may move towards the proximal end of tool 100. This may enable the removal of upper sub-assembly 130. In an alternative embodiment, the no-go 122 may be part of the lower sub-assembly while the collet 144 may be connected to the upper sub-assembly.

Upper sub-assembly 130 is configured to be inserted and removed from a wellbore independently from lower sub-assembly 110 and/or housing 120. Responsive to increasing the pressure or apply of force within tool 100, portions of upper sub-assembly may be repositioned and form a mechanical look that is not aligned with housing 120. This may allow upper sub-assembly 130 to move towards the proximal end of the wellbore. Upper sub-assembly 130 may include an outer sidewall 132, adjuster sleeve 140, and a support sleeve 150.

Outer sidewall 132 may be configured to be positioned on and adjacent to a proximal end of housing 120. By positioning outer sidewall 132 on housing 120, movement of upper sub-assembly 130 towards the distal end of tool 100 may be limited. An inner portion of outer sidewall 132 may be configured to be coupled to a proximal end of adjuster sleeve 140. A distal end of outer sidewall 132 may include an anti-rotational lock that is configured to mate with anti-rotational lock 190. Responsive to mating the anti-rotational locks, the rotation of upper sub-assembly 130 with respect to the housing 120 may be limited. The second set of anti-rotational locks positioned on the distal end of outer sidewall may include a second set of fingers and a second set of grooves. These second sets of fingers and grooves may be configured to be offset from the first set of fingers of grooves. For example, a first finger associated with the housing 120 is inserted into a second groove associated with the outer sidewall 132 and a second finger associated with outer sidewall 132 is configured to be inserted into a first groove housing 120.

Adjuster sleeve 140 may be a sleeve with a collet that is configured to remain coupled to outer sidewall 132 while support sleeve 150 moves towards a distal end of the wellbore. Adjuster sleeve 140 may include a coupling mechanism 141, upper portion 142, shear pin 160, shaft 144, a distal end that includes an outer projection 146 and an inner projection 148, and port 149.

The upper portion 142 of adjuster sleeve 140 may be configured to be coupled with outer sidewall 132 via coupling mechanism 141. Upper portion 142 may include a cutout 170 that is configured to receive a proximal end of support sleeve 150, when support sleeve 150 is in a first position. In embodiments, support sleeve 150 may be retained in the first position until the pressure within tool 100 increases past a threshold to cut/severe shear pin 160. This may decouple adjuster sleeve 140 and support sleeve 150 at a location associated with shear pin 160. In other embodiments, the adjuster sleeve 140 and the outer side wall 132 may be one piece.

Shaft 144 may be positioned between upper portion 142 and the distal end of adjuster sleeve 140. Shaft 144 may be configured to be positioned adjacent to an inner sidewall of housing 120 while upper sub-assembly 130 is coupled with lower sub-assembly 110. Shaft 144 may be configured to extend past shear pins 160 from upper portion 142 to the collet positioned on a distal end of adjuster sleeve 140. An inner diameter across shaft 144 may be greater than an inner diameter across the distal end of adjuster sleeve 140 and upper portion 142. In embodiments, shaft 144 may be spring loaded, have a natural flex, etc. that naturally moves the distal end of shaft 144 towards a central axis of tool 100. In other configurations, the shaft can be connecting to dogs, dies, etc.

Distal end of adjuster sleeve 140 may be a collet or any other mechanism that is configured to be selectively coupled to housing 120 at a first location or support sleeve 150 at a second location. This may enable upper sub-assembly 130 to be selectively coupled to lower sub-assembly 110, while allowing upper sub-assembly 130 to be mechanically removed from a wellbore. Distal end of adjuster sleeve 140 may include an outer projection 146 and an inner projection 148.

Outer projection 146 may be positioned on an outer sidewall of the distal end of adjuster sleeve 140, and may increase the outer diameter of the distal end of adjuster sleeve 140. Outer projection 146 may be configured to be vertically aligned with no-go 122 in the first mode of operation. This may limit the upward movement of adjuster sleeve 140 while outer projection 146 is aligned with no-go 122. In the second mode, outer projection 146 may not be aligned with no-go 122, such the adjuster sleeve 140 may move unrestricted by no-go 122.

The outer projection 146 may be collets that flex open, dies that retract, dogs supported with spring, or any other device that naturally or through mechanical assistance may have first larger diameter and second smaller diameters Inner projection 148 may be positioned on an inner sidewall of the distal end of adjuster sleeve 140, and may decrease the inner diameter of the distal end of adjuster sleeve 140. Inner projection 146 may be configured to be positioned adjacent to first outcrop 154 of support sleeve 150 in the first mode of operation. In the second mode of operation, inner projection 146 may be configured to be positioned within a groove between first outcrop 154 and second outcrop 156, and may be positioned adjacent to second outcrop 156. This may enable inner projection to apply a force against second outcrop 156 and move support sleeve 150.

Port 149 may be an orifice extending from an inner circumference of adjuster sleeve 140 to an outer circumference of adjuster sleeve 140. Port 149 may be positioned closer to a proximal end of adjuster sleeve 140 than a distal end of adjuster sleeve 140. Port 149 may be configured to allow communication between an inner diameter of adjuster sleeve 140 and an annulus outside of adjuster sleeve 140 while upper sub-assembly 130 is being removed from the wellbore. However, shear pin 160 is coupling adjuster sleeve 140 and support sleeve 150, an inlet of port 149 may be covered by support sleeve 150 and an outlet of port 149 may be covered by housing 120. Furthermore, when upper sub-assembly 130 is being removed from the wellbore, a proximal end of support sleeve 150 may be positioned below port 149, which may allow for the communication between the inner diameter of adjuster sleeve 140 and the annulus.

Support sleeve 150 may be a device that is configured to be selectively coupled to adjuster sleeve 140 at either a first location or second location, and to move along a linear axis of tool 100. Support sleeve 150 may move towards a distal end of tool 100 responsive to a ball drop and seating on seat 152 and a pressure increase within tool 100, and may move towards a proximal end of tool 100 responsive to adjuster sleeve 140 applying pressure to support sleeve 150 towards the proximal end of tool 100. Support sleeve 150 may include a seat 152, first outcrop 154, and second outcrop 156.

Seat 152 may be a projection extending around the inner circumference of support sleeve 150, which may decrease the inner diameter of support sleeve 150. Seat 152 may be configured to receive a ball, disc, object, seal, etc., and restrict the movement of the ball towards the distal end of tool 100. This may isolate a first area within the tool 100 above seat 152 from a second area within the tool 100 below seat 152. In embodiments, responsive to positioning the ball on seat 152, the pressure within the first area may increase, shearing pin 160, and moving support sleeve 150 towards the distal end of tool 100. In further embodiments, seat 152 may be coupled with an inner support that is configured to mechanically intervene and shear shearing pin 160. This may enable a failsafe to disconnect the upper sub-assembly 130 from lower sub-assembly that is mechanically operated.

First outcrop 154 and second outcrop 156 may be positioned on an outer diameter of support sleeve 150. First outcrop 154 and second outcrop 156 may increase the size of the outer diameter of support sleeve 150 such that a slot 158 may be formed between first outcrop 154 and second outcrop 156. In embodiments, first outcrop 154 may have a smaller outer diameter than that of second outcrop 156.

First outcrop 154 may be configured to be aligned with inner projection 148 in the first mode, which may limit the movement of the distal end of adjuster sleeve 140 towards a central axis of tool 100. In the second mode, the distal end of adjuster sleeve 140 may be aligned the groove/slot between first outcrop 154 and second outcrop 156, and the distal end of adjuster sleeve 140 may be coupled to support sleeve 150 at a second location.

Support sleeve 150 may also include a tapered distal end 180, and ports 182. The tapered distal end 180 may be a beveled, slopped, angled, etc. end that is configured to assist in positioning support sleeve within bottom sub-assembly 110. Ports 182 may be configured to allow for a communication bypass around the proximal end of support sleeve 150, between support sleeve 150 and adjuster sleeve 140 when the two are detached, and into the inner diameter of bottom sub assembly 110. This communication bypass may be configured to allow for a pressure drop indication within the wellbore due to the shearing or shear pin 160. Support sleeve 160 may be coupled to adjuster sleeve 140 via retaining pins 162, which couple the support sleeve 150 to adjuster sleeve 140 after support sleeve 150 has sheared.

Figure 2:
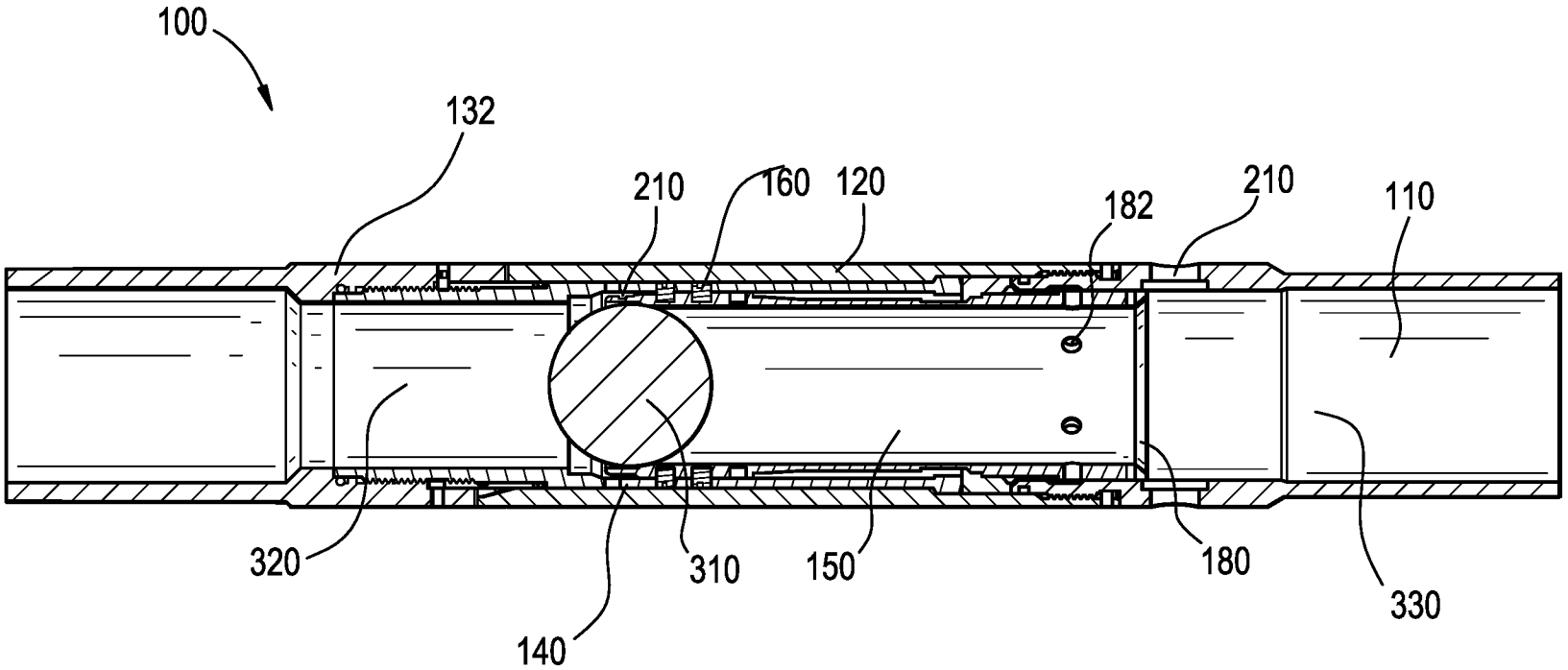
FIG. 2 depicts a tool, according to an embodiment.

FIG. 2 depicts tool 100, according to an embodiment. Elements depicted in FIG. 2 may be described above, and for the sake of brevity a further description of these matters is omitted.

As depicted in FIG. 2, responsive to burst disc 112 being ruptured, passageway 210 extending from an inner diameter of tool 100 to an annulus positioned outside of tool 100 may be exposed. This may allow for communication between the annulus and inner diameter of tool 100.

A ball 310 may be configured to sit on seat 152. Responsive to positioning ball 310 on seat 152, a first area 320 above ball 310 within the inner diameter of tool 100 may be isolated from a second area 330 positioned below ball 310 except through bypass 210.

Bypass 210 may be created within a space between the outer diameter of support sleeve 150 and the inner diameter of adjuster sleeve 120 and bottom sub-assembly. More so, the bypass 210 may be created responsive to shear pin 160 shearing, allowing support sleeve 150 to move down well.

Responsive to the pressure within the first area 320 increasing past a threshold, shear pin 160 may shear. This may decouple support sleeve 150 from adjuster sleeve 140 at the first location, allowing support sleeve 150 to move towards the distal end of tool 100.

Figure 3:
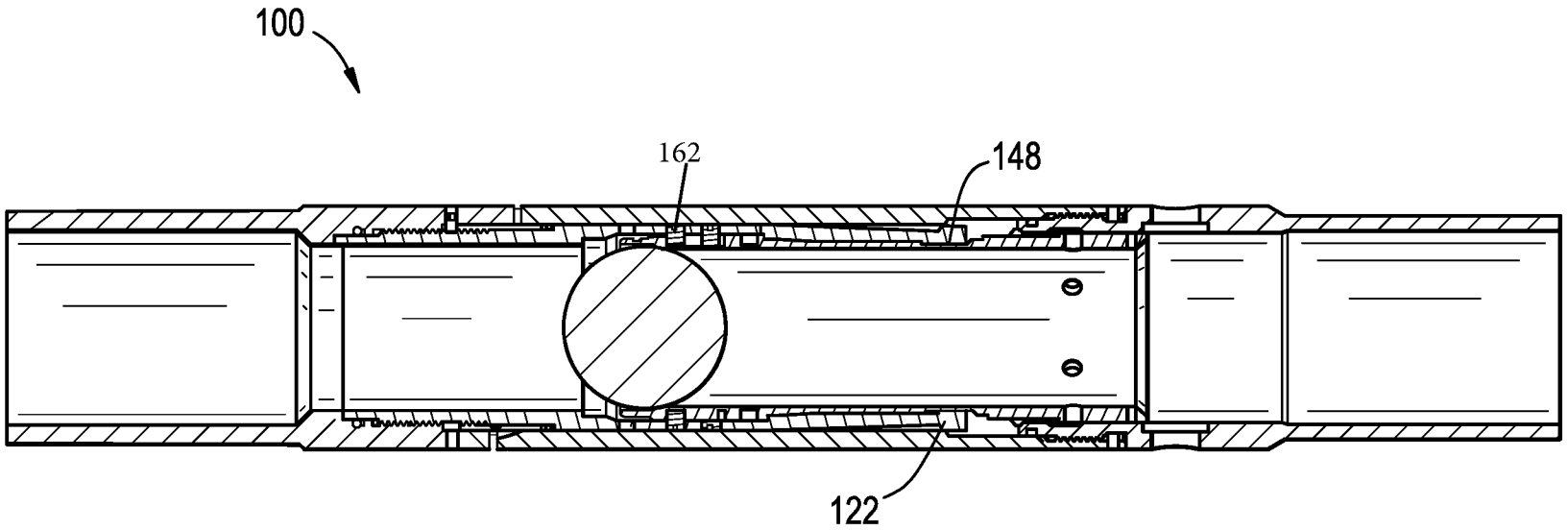
FIG. 3 depicts a tool, according to an embodiment.

As depicted in FIG. 3, when support sleeve 150 moves towards the distal end of tool 100, inner projection 148 may be positioned between first outcrop 154 and second outcrop 156. This may enable outer projection 146 to be positioned away from no-go 122.

Furthermore, when inner projection 148 is between first outcrop 154 and second outcrop 156, support sleeve 150 may be mechanically coupled to adjuster sleeve 140 at a second location, which is a different location than the first position of shear pin 160.

Figure 4:
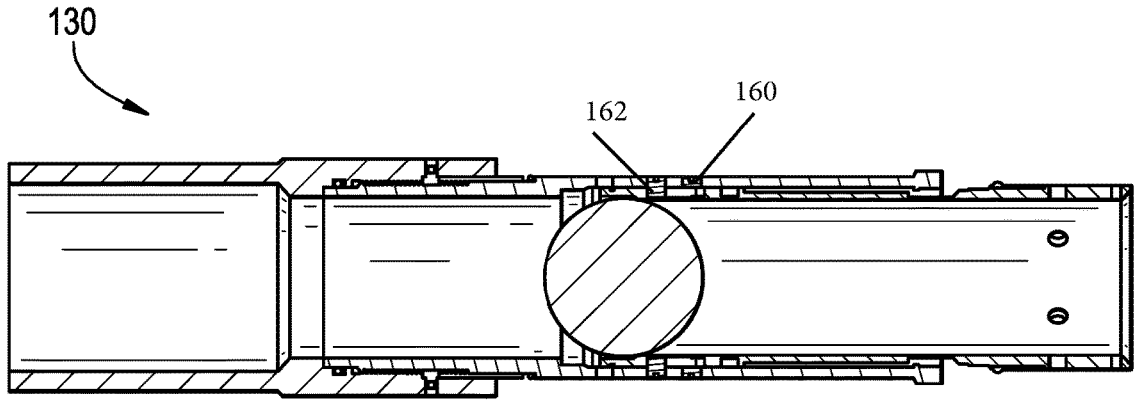
FIG. 4 depicts an upper sub-assembly according to an embodiment.

FIG. 4 depicts upper sub-assembly 130, according to an embodiment. Elements depicted in FIG. 4 may be described above, and for the sake of brevity a further description of these matters is omitted. Responsive to upper sub-assembly 130 being detached from housing 120 and lower sub-assembly 110, upper sub-assembly may be removed from a wellbore, while housing 120 and lower sub-assembly remain in the wellbore.

Figure 5:
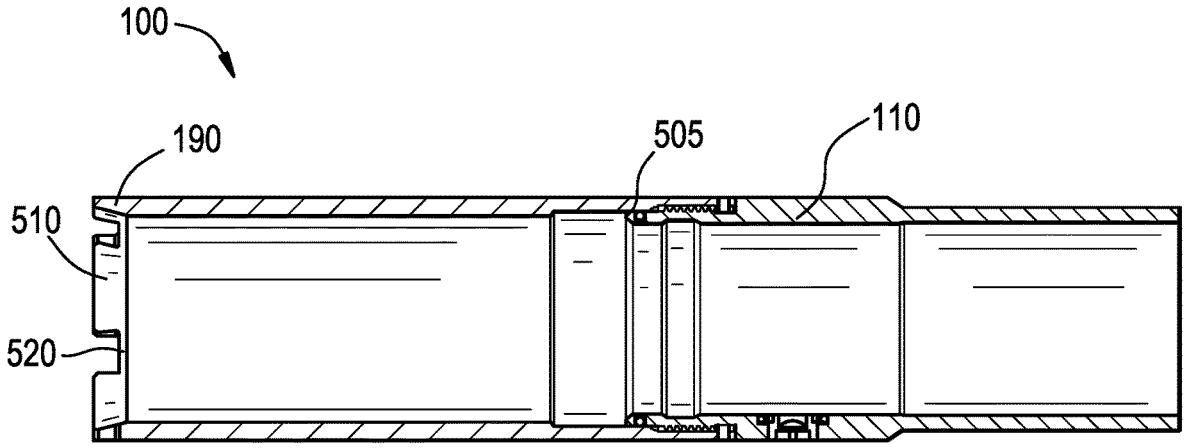
FIG. 5 depicts a tool, according to an embodiment.

FIG. 5 depicts tool 100, according to an embodiment. Elements depicted in FIG. 5 may be described above, and for the sake of brevity a further description of these matters is omitted.

After upper sub-assembly 130 receives an upward force to support sleeve 150 being mechanically coupled to adjuster sleeve 140, upper sub-assembly 130 may move as a single unit, and become detached from housing 120 and lower sub-assembly 110. This may enable portions of tool 100 to be separated and removed from a wellbore. Responsive to upper sub-assembly 130 being detached from housing 120 and lower sub-assembly 110, only housing 120 and lower sub-assembly 110 may remain in the wellbore. This may enable upper-sub-assembly 130 to be removed from the wellbore.

Furthermore, FIG. 5 depicts a beveled proximal end of housing 120, which included anti-rotational lock 190. Anti-rotational lock 190 includes a set of first fingers 510, and a set of first grooves 520. This first set of fingers and grooves may be configured to be interfaces with a second set of fingers and grooves on a distal end of the outer sidewall of the upper sub-assembly.

Additionally, a proximal end of bottom sub-assembly 110 may include a beveled rim 505, edge, etc. This may allow for an easier insertion of various tubing, tools, etc. through the wellbore, while operating as a no-go to limit the downward movement of the support sleeve after it shears.

Figure 6:
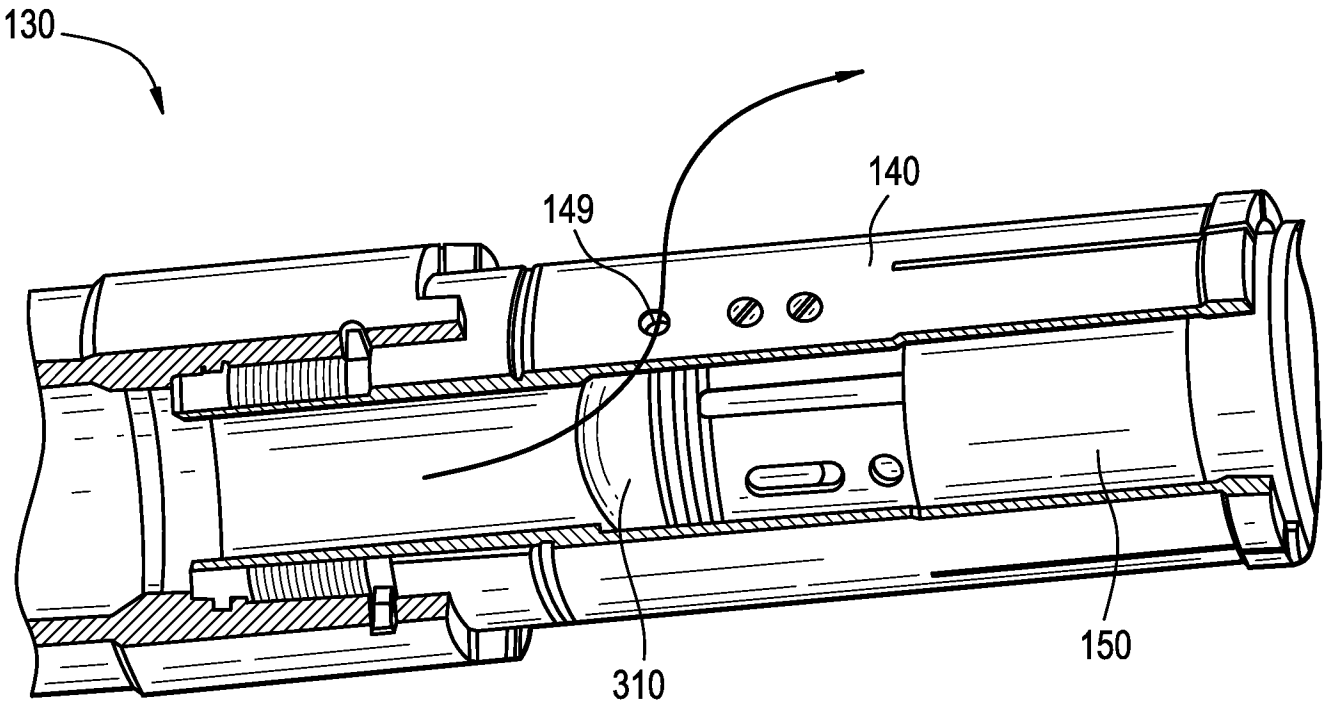
FIG. 6 depicts an upper sub-assembly, according to an embodiment.

FIG. 6 depicts upper sub-assembly 130, according to an embodiment. Elements depicted in FIG. 6 may be described above, and for the sake of brevity a further description of these matters is omitted.

As depicted in FIG. 6, responsive to upper sub-assembly 130 being removed from the wellbore, a fluid flow path from an inner diameter of adjuster sleeve 140 through an annulus may be created through ports 149, wherein ports 149 are positioned closer to a proximal end of upper sub-assembly 130 than object 310. This may allow for draining of fluid while upper sub-assembly 130 is being removed from the wellbore, which will require less upward force to remove upper sub-assembly 130 from the wellbore.

Figure 7:
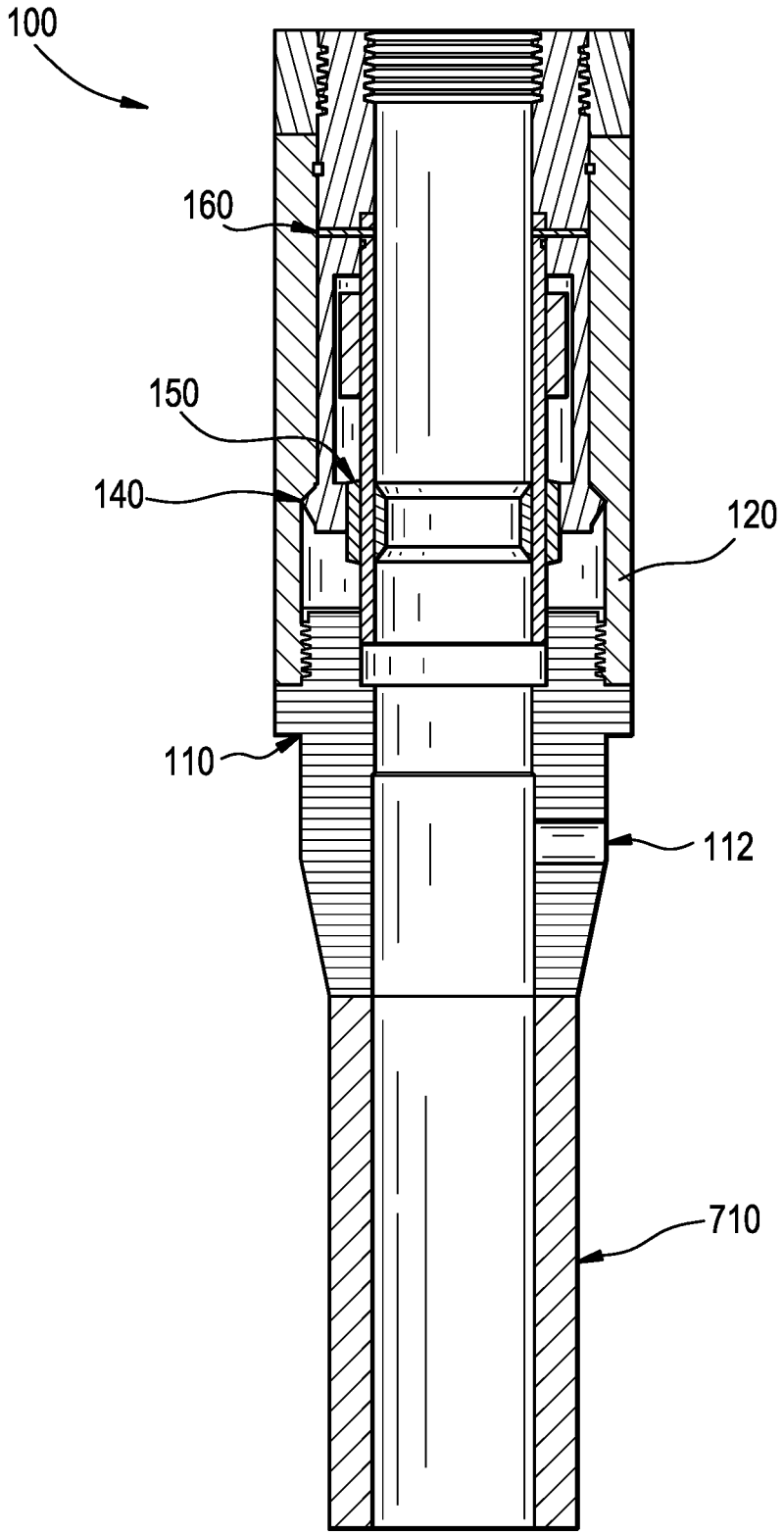
FIGS. 7 and 8 depict a tool, according to an embodiment.
Figure 8:
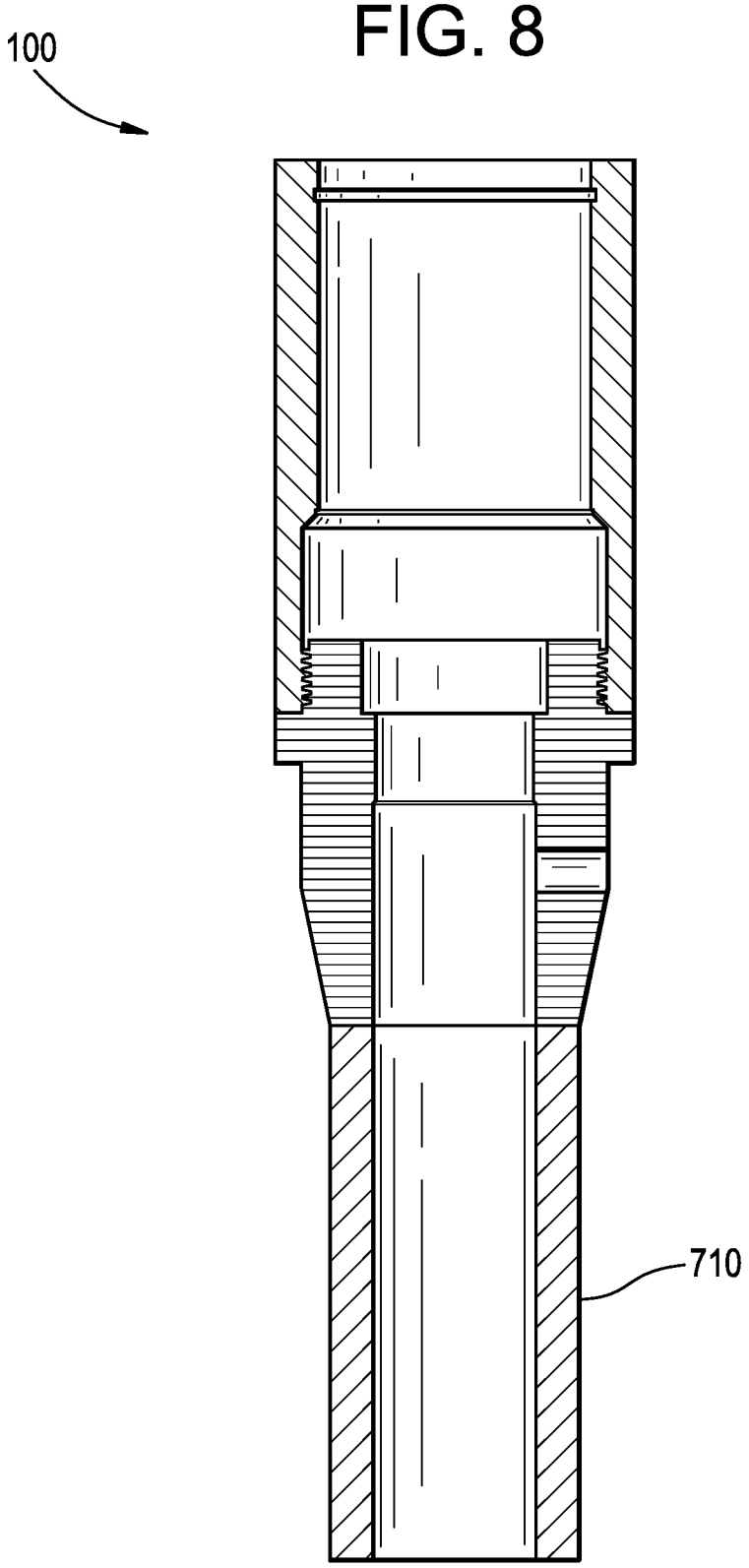

FIGS. 7 and 8 depict a tool 100, according to an embodiment. Elements depicted in FIGS. 7 and 8 may be described above, and for the sake of brevity a further description of these matters is omitted.

As depicted in FIG. 7, a seal bore 710 may be positioned on and end of bottom sub-assembly 110. As depicted in FIG. 8, this may allow bottom sub-assembly 110 to become an integral and permanent part of casing down.

Figure 9:
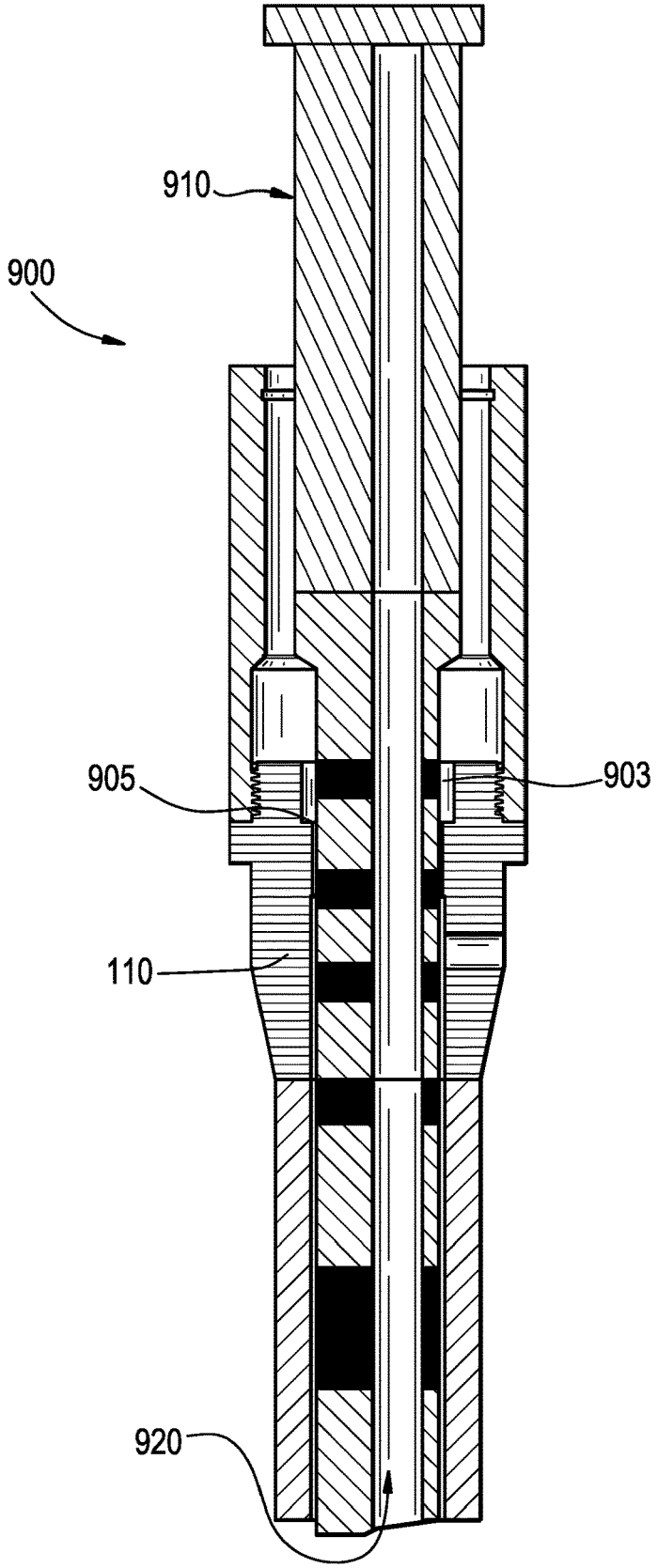
FIG. 9 depicts a tool, according to an embodiment.

FIG. 9 depicts a tool 100, according to an embodiment. Elements depicted in FIGS. 7 and 8 may be described above, and for the sake of brevity a further description of these elements may be omitted.

As depicted in FIG. 9, responsive to upper sub-assembly 130 being removed from the wellbore, production tubing 910 and a seal assembly 920 may be inserted through the tool 100 and seal bore 710. Utilizing the beveled edges, rims, etc. 903, 905 positioned on the inner diameter of bottom sub-assembly 110 production tubing and seal assembly 920 may be more efficiently and easily positioned within tool 100.

Figure 10:
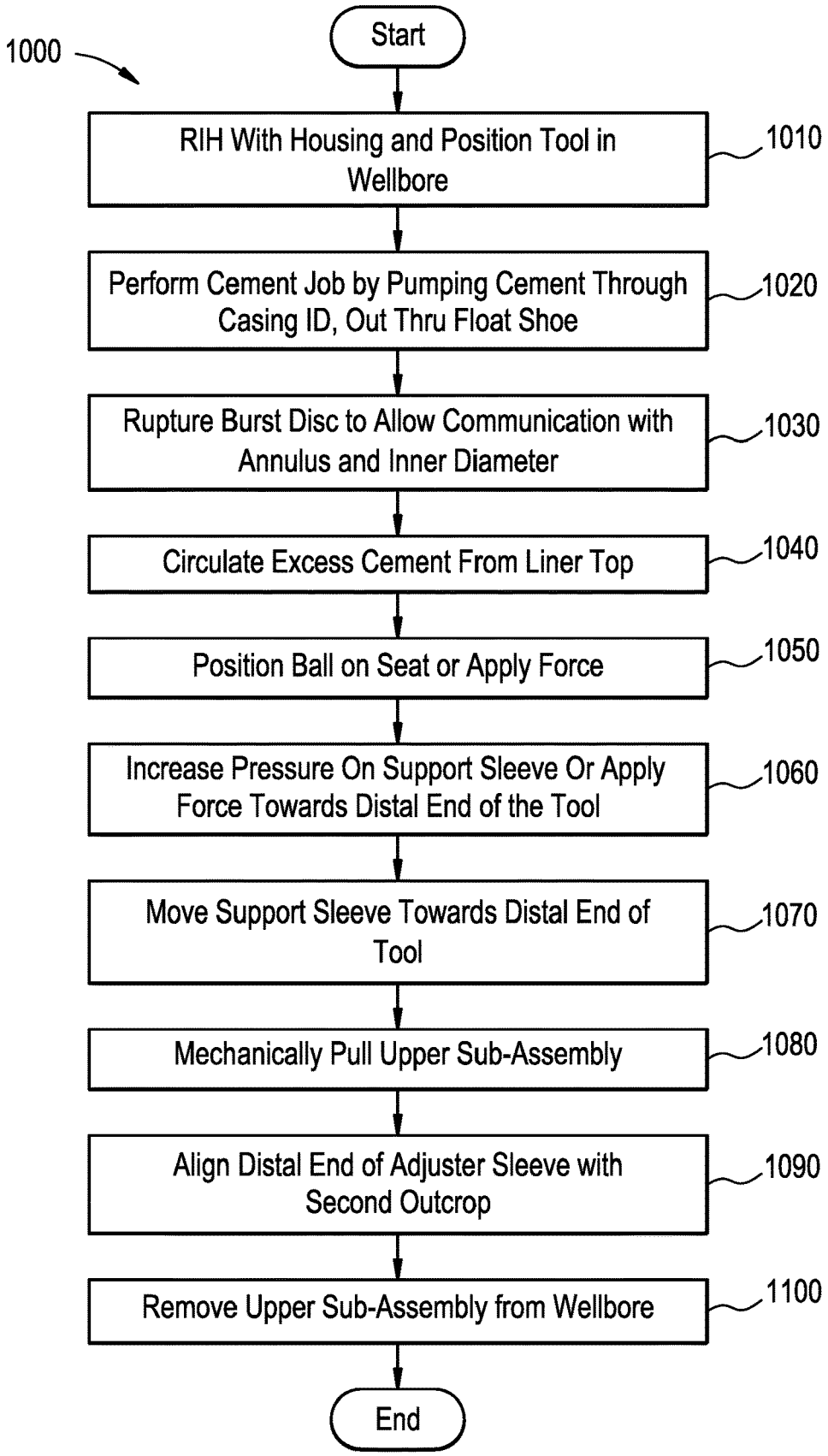
FIG. 10 depicts a method for detaching an upper sub-assembly from a lower sub-assembly, according to an embodiment.

FIG. 10 depicts a method 1000 for detaching an upper sub-assembly from a lower sub-assembly, according to an embodiment. The operations of method 1000 presented below are intended to be illustrative. In some embodiments, method 1000 may be accomplished with one or more additional operations not described, and/or without one or more of the operations discussed. Additionally, the order in which the operations of method 1000 are illustrated in FIG. 10 and described below is not intended to be limiting. Furthermore, the operations of method 1000 may be repeated for subsequent valves or zones in a well.

At operation 1010, a tool with housing, an upper sub-assembly, and lower sub-assembly may be positioned within a wellbore.

At operation 1020, a conventional casing cement job may be performed.

At operation 1030, a predetermined amount of pressure may be applied across a burst disc within the lower sub-assembly. The pressure applied to the burst disc may cause the burst disc to rupture, allowing communication between an area within the tool and an area outside of the tool.

At operation 1040, circulate through the burst rupture disc to allow any excess cement to be pumped out of the well.

At operation 1050, a ball may be positioned on a support sleeve of the upper sub-assembly. The ball may be configured to isolate an area above the ball from an area above the ball.

At operation 1060, pressure in the area above the ball within the tool may increase.

At operation 1070, responsive to increasing the pressure above the ball within the tool, a shear pin coupling the support sleeve to an adjuster sleeve may shear. The pressure may cause the support sleeve to move towards the distal end of the tool while the adjuster sleeve remains in place. When the support sleeve moves, a distal end of the adjuster sleeve may no longer be aligned with a first outcrop on the support sleeve. This may cause the distal end of the adjuster sleeve to become disengaged with a stop within the casing, and move towards a central axis of the tool.

At operation 1090, mechanically pull the upper sub-assembly towards proximal end of tool.

At operation 1090, responsive to pulling the upper sub-assembly, the distal end of the adjuster sleeve may be positioned adjacent to a second outcrop and the shaft, wherein the second outcrop may form a ledge over the distal end of the adjuster sleeve.

At operation 1100, the upper sub-assembly may be further pulled towards the proximal end of the wellbore. This may allow the upper sub-assembly to be removed from the wellbore, while the lower sub-assembly and housing remain.

Figure 11:
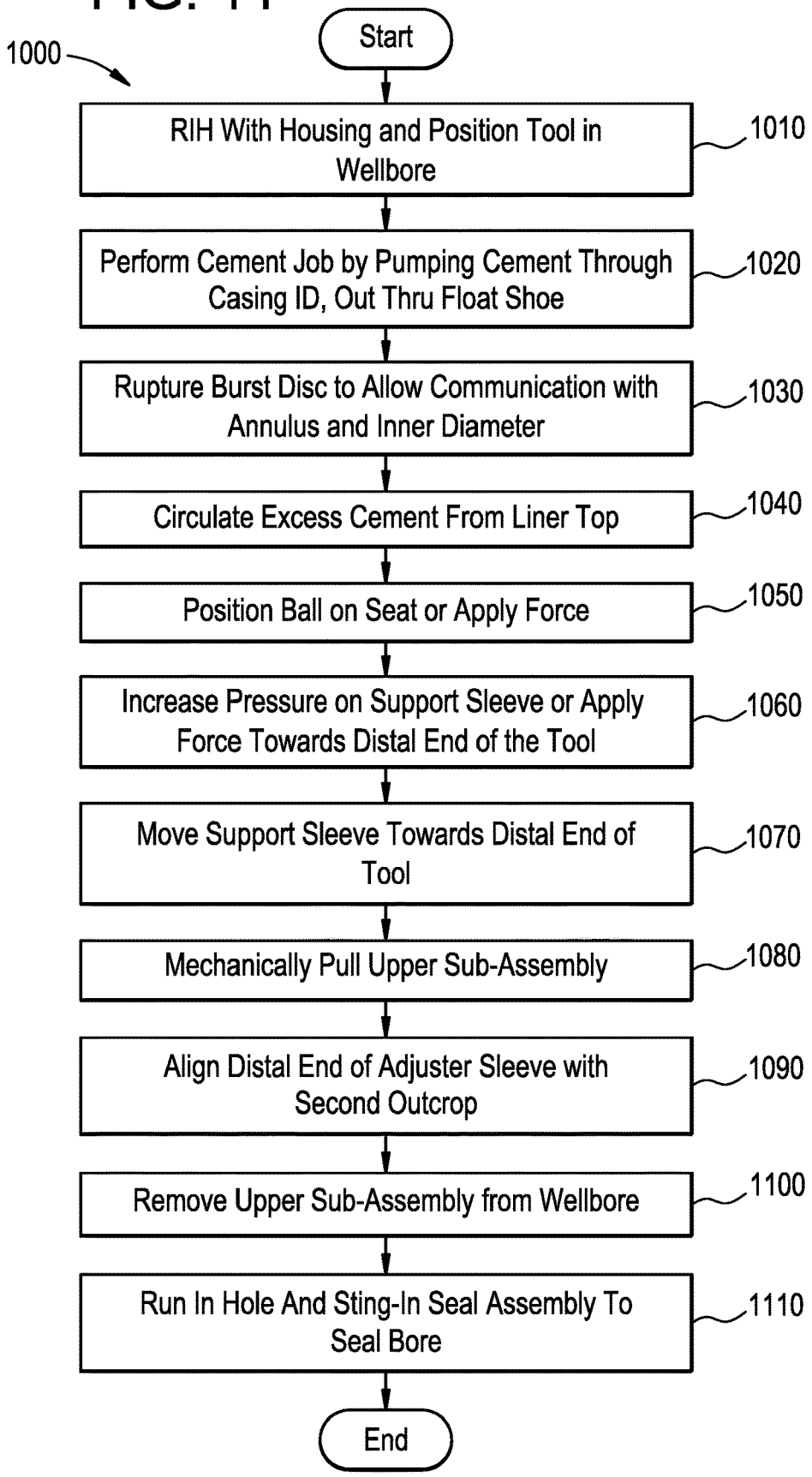
FIG. 11 depicts a method for detaching an upper sub-assembly from a lower sub-assembly, according to an embodiment.

FIG. 11 depicts a method 1105 for detaching an upper sub-assembly from a lower sub-assembly, according to an embodiment. The operations of method 1105 presented below are intended to be illustrative. In some embodiments, method 1105 may be accomplished with one or more additional operations not described, and/or without one or more of the operations discussed. Additionally, the order in which the operations of method 1105 are illustrated in FIG. 11 and described below is not intended to be limiting. Furthermore, the operations of method 1105 may be repeated for subsequent valves or zones in a well.

At operation 1010, a tool with housing, an upper sub-assembly, and lower sub-assembly may be positioned within a wellbore.

At operation 1020, a conventional casing cement job may be performed.

At operation 1030, a predetermined amount of pressure may be applied across a burst disc within the lower sub-assembly. The pressure applied to the burst disc may cause the burst disc to rupture, allowing communication between an area within the tool and an area outside of the tool.

At operation 1040, circulate through the burst rupture disc to allow any excess cement to be pumped out of the well.

At operation 1050, a ball may be positioned on a support sleeve of the upper sub-assembly. The ball may be configured to isolate an area above the ball from an area above the ball.

At operation 1060, pressure in the area above the ball within the tool may increase.

At operation 1070, responsive to increasing the pressure above the ball within the tool, a shear pin coupling the support sleeve to an adjuster sleeve may shear. The pressure may cause the support sleeve to move towards the distal end of the tool while the adjuster sleeve remains in place. When the support sleeve moves, a distal end of the adjuster sleeve may no longer be aligned with a first outcrop on the support sleeve. This may cause the distal end of the adjuster sleeve to become disengaged with a stop within the casing, and move towards a central axis of the tool.

At operation 1090, mechanically pull the upper sub-assembly towards proximal end of tool.

At operation 1090, responsive to pulling the upper sub-assembly, the distal end of the adjuster sleeve may be positioned adjacent to a second outcrop and the shaft, wherein the second outcrop may form a ledge over the distal end of the adjuster sleeve.

At operation 1100, the upper sub-assembly may be further pulled towards the proximal end of the wellbore. This may allow the upper sub-assembly to be removed from the wellbore, while the lower sub-assembly and housing remain.

At operation 1110, a seal bore may be run in hole. The seal bore may allow for a seal assembly to sting in and provide a sealant between the annulus and the inside diameter of a casing. This may allow for cement job remediation to the casing below through preforming a cement squeeze job. Further the seal assembly may isolate the annulus above from the produced well fluid during production operations.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A detachable tool for a wellbore comprising:

a bottom sub assembly configured to be coupled to an upper sub assembly;

the upper sub assembly including a support sleeve and an adjuster sleeve, the adjuster sleeve being decoupled from the bottom sub assembly based on downward linear movement of the support sleeve and inward movement of the adjuster sleeve, wherein a communication bypass is exposed after the downward linear movement of the support sleeve, wherein communication is established from a first area above an object positioned on the support sleeve to a second area below the object positioned on the support sleeve via the communication bypass after the downward linear movement of the support sleeve.

2. The detachable tool of claim 1, a port within the support sleeve allowing communication from inside the detachable tool to an area outside the detachable tool after the downward linear movement of the support sleeve.

3. The detachable tool of claim 2, wherein a collet of the adjuster sleeve is positioned on a second end of the adjuster sleeve.

4. The detachable tool of claim 2, wherein the port within the support sleeve is in communication with the communication bypass, the port being positioned below the object positioned across an inner diameter of the support sleeve.

5. The detachable tool of claim 2, wherein the port within the support sleeve is positioned above the object positioned across an inner diameter of the support sleeve.

6. The detachable tool of claim 1, wherein the adjuster sleeve is run in hole the adjuster sleeve is coupled to the support sleeve at a first location, and when pulled out of the hole the adjuster sleeve is coupled to the support sleeve at a second location.

7. The detachable tool of claim 6, wherein an outer diameter of the support sleeve outside diameter is variable.

8. The detachable tool of claim 6, wherein the support sleeve is coupled to the adjuster sleeve assembly via retaining pins after the support sleeve shears.

9. The detachable tool of claim 6, wherein the bottom sub assembly includes a no-go that limits the movement of the support sleeve after the support sleeve has sheared.

10. The detachable tool of claim 1, wherein the object blocks an inner diameter of the support sleeve.

11. The detachable tool of claim 1, wherein the support sleeve is retrieved as an integral part of the upper sub assembly.

12. The detachable tool of claim 1, further comprising:

a retaining device configured to couple the support sleeve and the adjuster sleeve after the downward linear movement of the support sleeve.

13. The detachable tool of claim 12, wherein the retaining device extends from an inner diameter of the adjuster sleeve into an outer diameter of the support sleeve.

14. A method for utilizing a detachable tool within a wellbore comprising:

coupling an upper sub assembly to a bottom sub assembly;

decoupling the upper sub assembly from the bottom sub assembly based on downward linear movement of a support sleeve and inward movement of an adjuster sleeve, wherein the upper sub assembly includes the support sleeve and the adjuster sleeve;

exposing a communication bypass between the support sleeve and the adjuster sleeve after the downward linear movement of the support sleeve; and establishing communication from a first area above an object positioned on the support sleeve to a second area below the object positioned on the support sleeve via the communication bypass after the downward linear movement of the support sleeve.

15. The method of claim 14, further comprising:

communicating fluid, via a port within the support sleeve, from inside the detachable tool to an area outside the detachable tool after the downward linear movement of the support sleeve.

16. The method of claim 15, wherein when the adjuster sleeve is run in hole the adjuster sleeve is coupled to the support sleeve at a first location, and when pulled out of the hole the adjuster sleeve is coupled to the support sleeve at a second location.

17. The method of claim 16, further comprising:

retrieving the support sleeve as an integral part of the upper sub assembly.

18. The method of claim 16, wherein an outer diameter of the support sleeve varies in size between a proximal end of the support sleeve and a distal end of the support sleeve.

19. The method of claim 16, further comprising:

coupling the support sleeve to the adjuster sleeve assembly via retaining pins after the support sleeve shears.

20. A method for utilizing a detachable tool for a wellbore comprising:

coupling an upper sub assembly to a bottom sub assembly;

restricting rotational movement of the upper sub assembly and the bottom sub assembly in two directions;

coupling an adjuster sleeve and a support sleeve together via a temporary coupling mechanism at a first location in a first mode, wherein the adjuster sleeve includes a shaft and a collet;

coupling the adjuster sleeve and the support sleeve together via the collet at a second location in a second mode based on downward linear movement of the support sleeve and inward movement of the adjuster sleeve, wherein an outer diameter of the support sleeve includes a projection, the projection being configured to interface with a no-go on an inner diameter of the bottom sub assembly to limit the downward linear movement of the support sleeve.

* * * * *